United States Patent [19]

Handzlik

[11] Patent Number: 4,823,968

[45] Date of Patent: Apr. 25, 1989

[54] CLOSURE FOR CARBONATED BEVERAGE CONTAINER WITH INTEGRAL PUMP MECHANISM

[76] Inventor: Walter A. Handzlik, 1305 W. Chestnut, West Bend, Wis. 53095

[21] Appl. No.: 236,143

[22] Filed: Aug. 25, 1988

[51] Int. Cl.[4] ..... B65D 51/24

[52] U.S. Cl. ..... 215/228; 215/260

[58] Field of Search ..... 215/228, 260

[56] References Cited

U.S. PATENT DOCUMENTS

| | | | |
|---|---|---|---|
| 4,033,091 | 7/1977 | Saponara | 215/228 X |
| 4,287,819 | 9/1981 | Emerit | 215/260 X |
| 4,524,877 | 6/1985 | Saxby et al. | 215/260 X |
| 4,640,426 | 2/1987 | Wasley | 215/228 |
| 4,723,670 | 2/1988 | Robinson et al. | 215/228 |
| 4,763,803 | 8/1988 | Schneider | 215/228 X |

*Primary Examiner*—Donald F. Norton

*Attorney, Agent, or Firm*—Andrus, Sceales, Starke & Sawall

[57] ABSTRACT

An apparatus for closing an open end of a mouth of a carbonated beverage container and pressurizing the interior of the container with air. The apparatus includes a base threaded on the mouth of the container to cover its open end and a cap surrounding the base and slidably mounted between upstroke and downstroke positions in order to pressurize the air space above the contents of a previously opened bottle. The apparatus also functions as a closure for maintaining the pressurized condition until the bottle is again opened. The apparatus includes in one form a plurality of locking key members on the cap and locking tabs on the base to hold the cap in its downstroke position. In another form, the lock comprises a rotatable annular collar disposed about the cap and threadedly engageable with an annular flange on the base.

12 Claims, 2 Drawing Sheets

CLOSURE FOR CARBONATED BEVERAGE CONTAINER WITH INTEGRAL PUMP MECHANISM

BACKGROUND OF THE INVENTION

The present invention relates to carbonated beverage containers, and more particularly to an apparatus for cloising an open end of a mouth of a carbonated beverage container and for pressurizing the interior of the container with air.

A carbonated beverage typically occupies only a portin of the volume of a sealed container and tends to go "flat" due to the tendency of the carbonated gases to achieve equal pressure level to that of the air above the liquid within the container. The usual recapping of a once opened container and its subsequent storage further diminishes the carbonation in the beverage since as the liquid volume to air volume ratio decreases the carbonated gases within the beverage continuously escape into the air above the liquid in the container. As a result, subsequent pourings of the beverage from the container are noticeably flat.

Various types of devices have been proposed in an attempt to prevent the carbonated beverage from going flat or loosing its "fizz". Some of these devices include a piston reciprocating within a cylinder disposed within the container, as in U.S. Pat. No. 4,524,877, while others tend to employ bellows type pumping devices such as in U.S. Pat. Nos. 4,033,091 and 4,640,426 or expandable bladders in the space above the carbonated beverage within the container as in U.S. Pat. No. 4,482,072.

It is also known to preserve wine by pressurizing the air above the wine in the a bottle with argon or carbon dioxide gas as in U.S. Pat. No. 4,477,477. Additionally, various devices are known for carbonating a beverage within a container as shown in U.S. Pat. Nos. 4,082,123, 1,022,968 and 711,459. Finally, pumping devices such as that shown in U.S. Pat. No. 2,612,297 for dispensing ketchup and the like from bottles are also known.

SUMMARY OF THE INVENTION

An apparatus for closing an open end of a mouth of a carbonated beverage container and for pressurizing the interior of the container with air.

The apparatus includes a base threadedly engageable on the mouth of the container and a cap including a cover having a port therethrough and a depending wall portion surrounding the base. The base includes a lid portion covering the open end of the container with the lid portion containing a opening therethrough to permit passage of air into the interior of the container. The cap slidably mounts on the base between an upstroke position wherein the cover is spaced from the lid portion to define a pumping chamber above the base and a downstroke position wherein the cover is adjacent the lid portion to pump air into the chamber through the opening in the base into the interior of the container. A seal is disposed between the base and depending wall portion of the cap for sealing the depending wall portion against the base. Valve means is also provided mounted in the cover of the cap and in the lid portion of the base which allows air into the pumping chamber on the upstroke of the cap and displaces the air into the interior of the container on the downstroke of the cap.

The apparatus also includes locking means located exteriorly of the container for locking the cap in its downstroke position. In one form, the locking means comprises at least one key member depending from the interior of the cap, at least one keyway formed in the base for receiving the key member, and at least one locking tab projecting from the base into the pumping chamber whereby upon rotation of the cap the key member and locking tab interlock to hold the cap in its downstroke position. The interlocking arrangement of the key member and locking tab is provided by means of mating tapered surfaces. In another form, the locking means comprises a rotatable annular collar disposed about the lower end of the cap and positioned to threadedly engage with an annular flange on the base.

The present invention thus provides a simple and effective device adapted to pump air into the interior of a previously opened container to prevent the beverage therein from going flat. The device also functions as a closure for maintaining the pressurized condition until the bottle is reopened.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
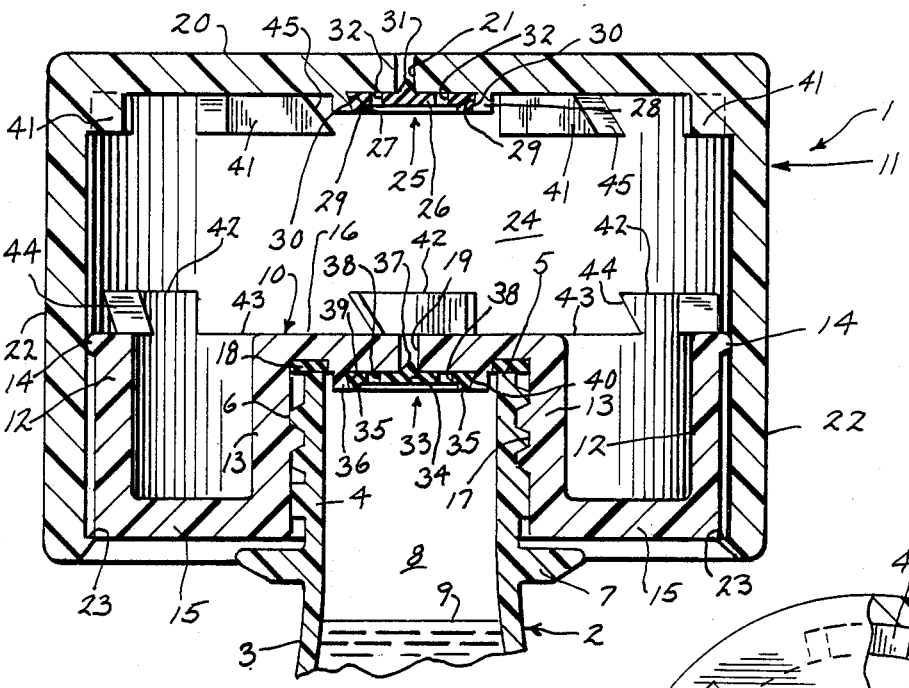
FIG. 1 is a fragmentary cross sectional side view in elevation of a pressurizing and closure device constructed in accordance with the present invention.
Figure 2:
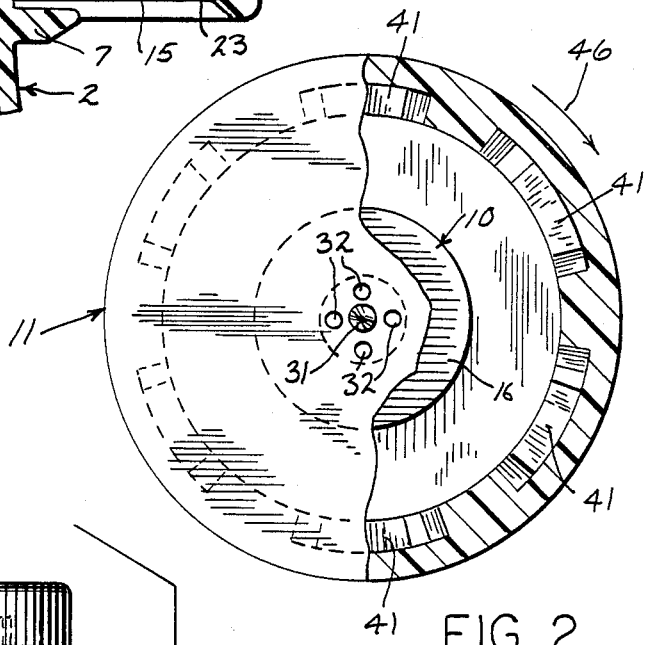
FIG. 2 is a top plan view with parts broken away and in section of the device of FIG. 1.
Figure 3:
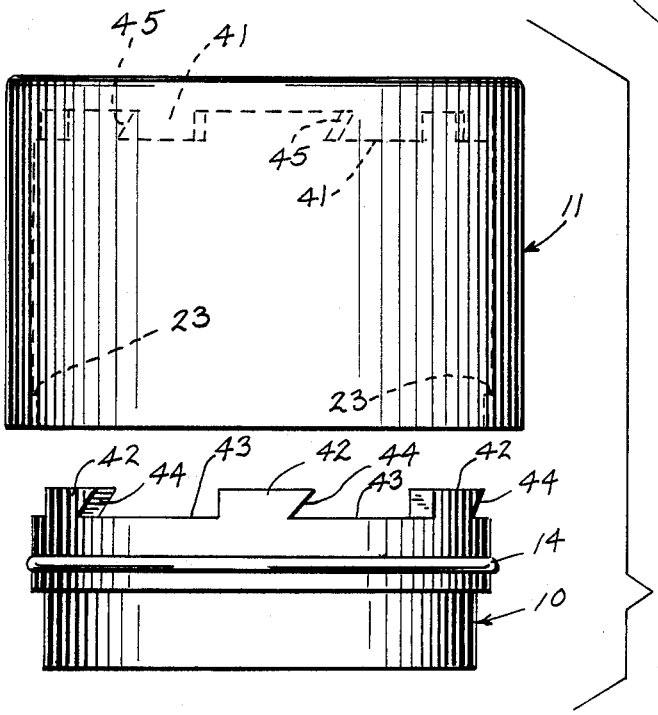
FIG. 3 is an exploded side view in elevation of the device of FIG. 1.

Referring now to the drawings, FIGS. 1–3 illustrate a pressurizing and closure device, generally designated by the numeral 1, mounted on the open end of the mouth of a carbonated beverage container 2. As illustrated, container 2 is of the conventional type having a body 3 and a mouth 4 with an open annular end 5. Mouth 4 includes the usual external threads 6 as well as annular flange 7. As is also conventional, container 2 is typically composed of a plastics material, and defines an air space 8 above a carbonated beverage or liquid 9 container therein.

Device 1 includes a base 10 mounted on mouth 4 of container 2, and a cap 11 slidably mounted on base 10. Base 10 is of a cylindrical shape, as shown best in FIG. 3, and includes an annular outer wall 12 and an annular inner wall 13. Outer wall 12 includes an annular bead or flange 14 projecting radially outwardly therefrom at its upper end and slidably, frictionally engageable with cap 11 for sealing cap 11 against base 10, as will hereinafter be described. Outer wall 12 and inner wall 13 are integrally connected by means of an annular lower wall 15 and the upper ends of inner wall 13 are integrally interconnected by means of an upper wall or lid portion 16. As shown best in FIG. 1, inner wall 13 and lid portion 16 define a container receiving opening dimensioned to have a diameter substantially identical to the mouth 4 of container 2 and to include interior threads 17 for threaded engagement with exterior threads 6 on mouth 4 of container 2. A rubber washer 18 is disposed between lid portion 16 and the upper edge of mouth 4 of container 2 for providing a seal therebetween. As seen best in FIG. 1, lid portion 16 of base 10 includes a central opening formed therethrough to permit passage of air into the air space 8 of container 2.

Cap 11 includes a cover 20 having a central port 21 formed therethrough and an integral depending annular wall portion 22 surrounding outer wall 12 of base 10. As seen best in FIG. 1, the diameter of wall portion 22 is dimensioned to be slightly greater than the diameter of outer wall 12 yet provide frictional sliding contact with the outer surface of flange 14 to provide a seal therebetween. Wall portion 22 of cap 11 also includes an inwardly projecting annular abutment surface 23 disposed at its lower end which functions as a stop engageable with flange 14 for limiting the sliding displacement of cap 11 with respect to base 10. As shown in FIG. 1, cap 11 is slidably mounted on base 10 for reciprocal movement between an upstroke position, as shown in FIG. 1 wherein cover 20 is spaced from lid portion 16 and a downstroke position wherein cover 20 is adjacent lid portion 16 to pump air from a pumping chamber 24 defined by the air space above lid portion 16 and below cover 20 through opening 19 into the air space 8 within container 2.

In order to accomplish the displacement of air from chamber 24 into air space 8 within container 2, device 1 includes a resilient umbrella valve 25 having a head portion 26 and an annular depending leg portion 27 mounted on the lower base of cover 20 within chamber 24. In order to hold valve 25 in the position shown in FIG. 1, head portion 26 and leg portion 27 are received within an annular depending seat 28 which includes an annular tapered surface 29 which converges downwardly into chamber 24. Leg portion 27 of valve 25 includes a mating tapered surface 30 which frictionally engages surface 29 to hold valve 25 in seat 28. Head portion 26 of valve 25 also includes a cone-shaped projection 31 extending from its upper face into port 21 to ensure tight sealing engagement between valve 25 and port 21. Head portion 26 further includes four circumferentially arranged passages formed therethrough. Passages 32 are located radially outwardly of projection 31 between projection 31 and the outer periphery of head portion 26. Passages 32 are thus closed, as shown in FIG. 1, during the downstroke of cap 11 and are open to allow displacement of air from the exterior of device 1 through port 21 into chamber 24 during the upstroke of cap 11 as a result of the downward flexing of head portion 26 away from the lower face of cover 20.

A second umbrella valve 33 having head portion 34 and annular leg portion 35 is disposed in a seat 36 on the lower face of lid portion 16 of base 10. Valve 33 also includes a projection 37 and four passages 38 as well as mating tapered surfaces 39, 40 on seat 36 and leg portion 35 respectively. Valve 33 operates in a manner similar to valve 25 except that valve 33 allows air to be displaced through opening 19 from chamber 24 into air space 8 of container 2 during the downstroke of cap 11 and seals opening 19 during the upstroke of cap 11.

As an alternative to umbrella valves 25 and 33, a pair of flapper type valves (not shown) might be employed. Such valves are also composed of a resilient material and include a disk portion similar to head portions 26 and 34 and a stem portion which would extend through port 21 and opening 19, respectively, to hold the flapper valves in position. Additionally, instead of passages 32 and 38 being formed in the valve itself these passages would be formed through cover 20 and lid portion 16 when utilizing flapper type valves. An example of the type of flapper valve contemplated for use herein may be found in FIGS. 1 and 2 of U.S. Pat. No. 4,524,877 previously cited herein.

Device 1 also includes locking means located exteriorly of container 2 for locking cap 11 in its downstroke position. In order to accomplish this, the locking means comprises a plurality of circumferentially spaced key members 41 depending from the underside of cover 20 of cap 11 which project into chamber 24 together with a plurality of circumferentially spaced locking tabs 42 projecting upwardly into chamber 24 and disposed about the upper edge of outer wall 12 of base 10. Locking tabs 42 also define a plurality of spaced keyways 43 therebetween each of which receives a key member 41 therein prior to the locking engagement of key members 41 and locking tabs 42. Each locking tab 42 includes a tapered surface 44 formed along one edge thereof which matingly engages with a corresponding tapered surface 45 on each of key members 41. As a result, in order to lock cap 11 in its downstroke position to base 10, cap 11 is first manually pushed downwardly so that key members 41 are received within keyways 43. Cap 11 is then rotated in a clockwise manner, as shown by arrow 46 in FIG. 2, until the locking surfaces 45 of key members 41 engage the locking surfaces 44 on locking taps 42 to interlock key members 41 and locking tabs 42 to hold cap 11 in its downstroke position.

After a portion of carbonated beverage 9 has been removed from container 2, container 2 must be sealed and pressurized in such a manner as to keep the carbonation in the beverage from filling the volume or air space 8 left by the dispensed beverage and also from escaping from container 2 itself. This is accomplished by the operation of the pressurizing and closure device 1 by first threadedly engaging device 1 on mouth 4 of container 2. Cap 11 is then rotated in a counterclockwise direction to release cap 11 from base 10. Thereafter, cap 11 is slidably reciprocated on base 10 between its initial downstroke position to an upstroke position wherein cover 20 is spaced from lid portion 16. As cap 11 is moved upwardly from base 10, air enters chamber 24 through port 21 and passages 32 while valve 33 remains seated against the underside of lid portion 16. After cap 11 reaches its upper displacement limit wherein abutment surfce 23 engages flange 14, cap 11 is manually forced downwardly whereupon valve 25 closes and valve 33 opens to allow air from chamber 24 to pass through opening 19 and passages 38 into air space 8 within container 2. The above procedure is repeated until resistance to pumping occurs. When this occurs, the pressure in air space 8 is greater than the pressure of the gas in the carbonated beverage. At this time, cap 11 is moved to its downstroke position and rotated clockwise in order to lock cap 11 in its downstroke position, as previously described herein.

Figure 4:
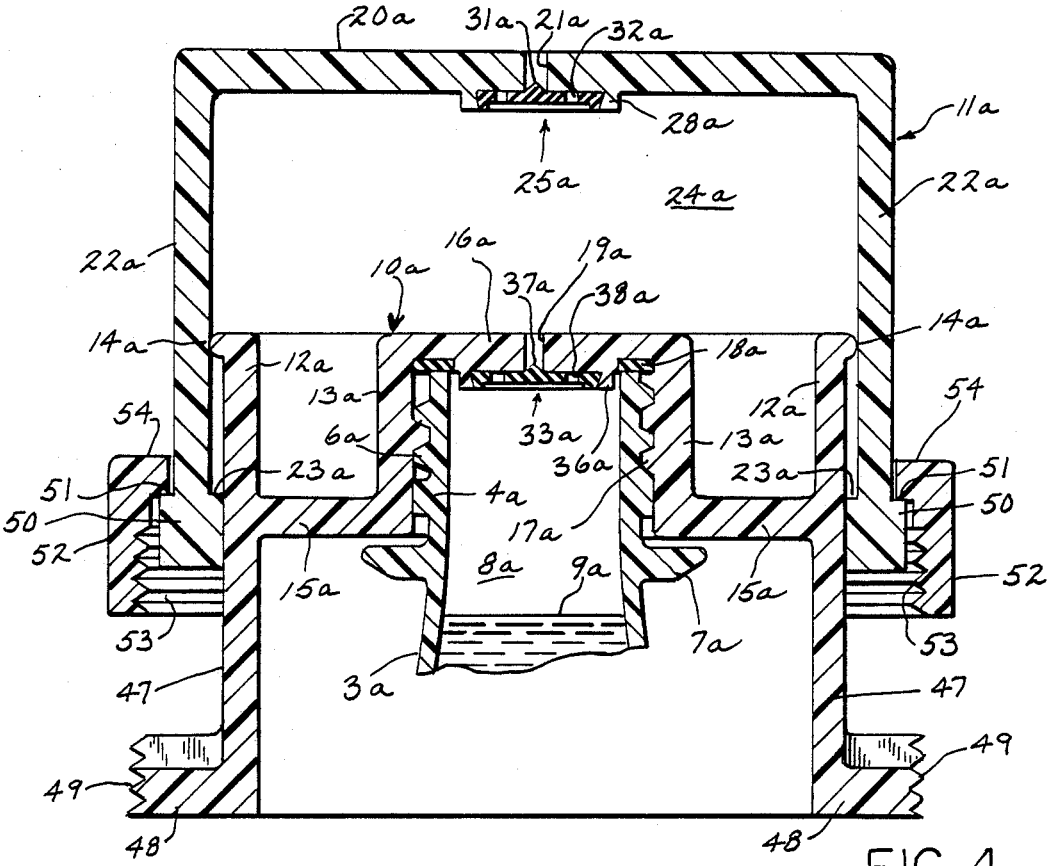
FIG. 4 is a fragmentary cross sectional side view in elevation similar to FIG. 1 of a second embodiment of the present invention.
Figure 5:
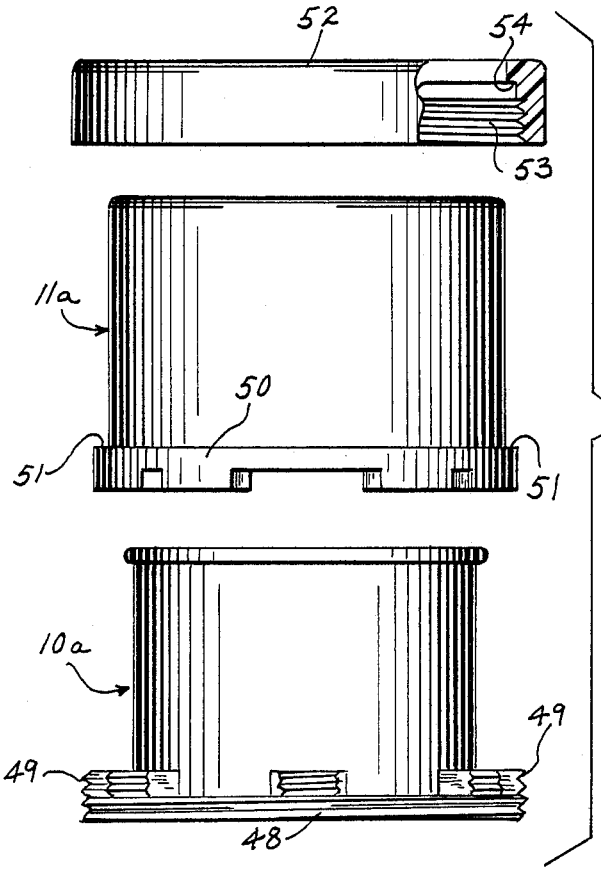
FIG. 5 is an exploded side view in elevation of the device of FIG. 4.

Referring now to FIGS. 4 and 5, there is illustrated a second embodiment of the pressurizing and closure device of the present invention. This second embodiment differs from the first embodiment shown in FIGS. 1-3 only with respect to the structure for locking the cap to the base. Therefore, like components have been illustrated with the subscript "a" and only those components differing from that shown in FIG. 1 will hereinafter be described. To this end, base **10*a* includes an outer annular wall 12*a* which extends downwardly from lower wall 15*a* to provide an annular skirt 47 which includes at its lowermost end an annular radially outwardly projecting flange 48 having external threads 49 formed therein. Cap 11***a* includes an annular ring 50 disposed at the lowermost end of its depending wall portion 22*a* which includes a ledge 51 projecting radially outwardly from wall portion 22 opposite abutment surface 23*a*. A rotatable annular collar 52 is disposed about depending wall portion 22*a* of cap 11*a* and includes internal threads 53 at its lower end a radially inwardly directed flange 54 at its upper end which engages ledge 51 of ring 50.

In operation, in order lock cap 11*a* to base 10*a* cap 11*a* is first pushed downwardly to its downstroke position and collar 52 is rotated clockwise until threads 53 engage threads 49 and flange 54 locks tightly against ledge 51 of ring 50. In order to release cap 11*a* from base 10*a* the opposite procedure is followed.

An apparatus for closing the opening end of a mouth of a carbonated beverage container and for pressurizing the interior of the container with air has been illustrated and described. The apparatus provides a simple and economical device for preventing carbonated beverages from going flat. Although specific components of the device have been illustrated and described herein various modifications and/or substitutions of the specific components described herein may be made without departing from the scope of the present invention. For example, the components described herein may be composed of various materials depending upon the economics desired.

Various modes of carrying out the invention are contemplated as being within the scope of the following claims particularly pointing out and distinctly claming the subject matter regarded as the invention.

I claim:

1. An apparatus for closing an open end of a mouth of a carbonated beverage container and for pressurizing the interior of the container with air, comprisng:

a base threadably engageable on the mouth of the container, said base including a lid portion covering the open end of the container, said lid portion containing an opening therethrough to permit passage of air into the interior of the container;

a cap including a cover having a port therethrough and a depending wall portion surrounding said base, said cap slidably mounted on said base between an upstroke position wherein said cover is spaced from said lid portion to define a pumping chamber above said base and a downstroke position wherein said cover is adjacent said lid portion to pump air from said chamber through said opening into the interior of said container;

sealing means disposed between said base and depending wall portion of said cap for sealing the depending wall portion against the base;

first valve means mounted in the cover of said cap which allows air to be displaced through said port into said pumping chamber on the upstroke of said cap and seals said port on the downstroke of said cap; and second valve means mounted in the lid portion of said base which allows air to be displaced through said opening from said pumping chamber into the interior of said container on the downstroke of said cap and seals said opening on the upstroke of said cap.

2. The apparatus of claim 1 wherein said sealing means comprises a flange projecting from said cap.

3. The apparatus of claim 2 wherein the depending wall portion of said cap includes stop means engageable with said flange for limiting the sliding displacement of said cap on said base.

4. The apparatus of claim 1 further including washer means disposed between said lid portion and the mouth of the container for providing a seal therebetween.

5. The apparatus of claim 1 wherein said first valve means comprises a resilient umbrella valve having a head portion fixed at its periphery and including at least one passage formed therethrough adjacent its periphery.

6. The apparatus of claim 5 wherein said umbrella valve further includes a projection extending from said head portion into said port.

7. The apparatus of claim 1 wherein said second valve means comprises a resilient umbrella valve having a head portion fixed at its periphery and including at least one passage formed therethrough adjacent its periphery.

8. The apparatus of claim 7 wherein said umbrella valve further a includes projection extending from said head portion into said opening.

9. The apparatus of claim 1 further including locking means located exteriorly of the container for locking the cap in said downstroke position.

10. The apparatus of claim 9 wherein said locking means comprises at least one key member depending from the cover of said cap, at least one keyway formed in said base for receiving said key member and at least one locking tab projecting from said base into said chamber whereby upon rotation of said cap said key member and locking tab interlock to hold said cap in said downstroke position.

11. The apparatus of claim 10 wherein said key member and said locking tab include mating tapered surfaces.

12. The apparatus of claim 9 wherein said locking means comprises a rotatable annular collar disposed about the depending wall portion of said cap, said collar threadedly engageable with an annular flange on said base.

* * * * *

UNITED STATES PATENT AND TRADEMARK OFFICE

CERTIFICATE OF CORRECTION

PATENT NO. : 4,823,968

DATED : April 25, 1989

INVENTOR(S) : WALTER A. HANDZLIK

It is certified that error appears in the above-identified patent and that said Letters Patent is hereby corrected as shown below:

Claim 1, Col. 5, Line 38, after "air," delete "comprisng" and substitute therefore -- comprising --; Claim 8, Col. 6, Line 34, after "further" delete "a".

Signed and Sealed this

Sixth Day of November, 1990

*Attest:*

HARRY F. MANBECK, JR.

*Attesting Officer*

*Commissioner of Patents and Trademarks*